US007584541B2

(12) United States Patent
Uchiyama

(10) Patent No.: US 7,584,541 B2
(45) Date of Patent: Sep. 8, 2009

(54) ROTARY ELECTRIC SHAVER

(75) Inventor: Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 181 days.

(21) Appl. No.: 11/593,812

(22) Filed: Nov. 7, 2006

(65) Prior Publication Data

US 2007/0101575 A1 May 10, 2007

(30) Foreign Application Priority Data

Nov. 9, 2005 (JP) ..... 2005-325128

(51) Int. Cl.
*B26B 19/14* (2006.01)

(52) U.S. Cl. ..... 30/43.4; 30/43.6

(58) Field of Classification Search ..... 30/43.4–43.6, 30/43

See application file for complete search history.

(56) References Cited

U.S. PATENT DOCUMENTS 3,624,681 A * 11/1971 Zuurveen et al. ..... 30/43.5
3,656,235 A * 4/1972 Zuurveen ..... 30/346.51
4,168,570 A 9/1979 Bakker et al.
RE30,857 E * 2/1982 Tyler ..... 30/43.5
5,983,502 A * 11/1999 Geertsma et al. ..... 30/43.6
2001/0042308 A1 * 11/2001 Barish ..... 30/43.6
2007/0256302 A1 * 11/2007 Okabe ..... 30/43.6
2008/0092393 A1 * 4/2008 Van Der Meer ..... 30/43.6

FOREIGN PATENT DOCUMENTS

JP 9-503424 4/1997
WO WO 9602368 2/1996

* cited by examiner

*Primary Examiner*—Jason Daniel Prone
*Assistant Examiner*—Joseph DeFrank
(74) *Attorney, Agent, or Firm*—William L. Androlia; H. Henry Koda

(57) ABSTRACT

A rotary electric shaver including a substantially disc-shaped outer cutter 18 having hair introduction openings and held in the upper part of the shaver main body 50 housing therein a motor, and an inner cutter that, while elastically contacting the inner surface of the outer cutter 18, is rotationally driven by the motor; and the shaver further including an outer cutter frame 14A provided on the shaver main body 50, and a skin protection rim 16 that is interposed between the outer cutter frame 14A and the outer cutter 18 to hold the outer cutter 18 and is elastically provided so as to be depressible with respect to the outer cutter frame 14A.

4 Claims, 6 Drawing Sheets

ROTARY ELECTRIC SHAVER

BACKGROUND OF THE INVENTION

1. Field of the Invention

The present invention relates to a rotary electric shaver in which an outer cutter is provided in the upper part of a shaver main body and hair entering the hair introduction openings of the outer cutter is cut by a rotating inner cutter while it makes elastic contact with the outer cutter.

2. Description of the Related Art

In rotary electric shavers, outer cutters are generally provided depressible (or are provided so as to sink into an outer cutter frame) so as to enhance a tight contact between the outer cutter and the shaving skin. In other words, an outer cutter frame provided on a shaver main body is formed with an outer cutter mounting hole(s), and the outer cutter(s) is installed therein from below so that the outer cutter(s) is elastically pushed upward.

So as to accomplish the structure above, a compression coil spring is ordinarily used, and it is provided on a drive shaft that rotationally drives the inner cutter. An upward return tendency is imparted by this compression coil spring to urge the drive shaft upward, and the inner cutter is thus caused to elastically contact the outer cutter by the upward restorative force of the drive shaft, so that an upward restorative force is imparted to the outer cutter. Because of this structure, the outer cutter can be pushed down and can also pivot within the range of a gap between the outer cutter mounting hole in the outer cutter frame and the outer circumference of the outer cutter.

In rotary electric shavers in which the outer cutter(s) is made capable of making pivot motion with respect to the outer cutter frame, when the range of outer cutter pivot angle is small, and particularly when the curvature of irregularities in the skin surface is small, a tight contact between the outer cutter and the skin becomes is not obtained. Also, when the skin cannot make tight contact with the entire surface of the outer cutter, the utilization efficiency of the outer cutter is poor, and the feel of shaving deteriorates.

One conceivable way of resolving the above-described problem would be to make the allowable angle of pivot motion of the outer cutter with respect to the outer cutter frame larger. If this is done, however, the circumferential edge of the outer cutter will strike the skin at an acute angle, and the contact pressure of the skin against the circumferential edge of the outer cutter will increases. As a result, the skin will be pushed into the hair introduction openings in the outer cutter during shaving, excessively close shaving, with a burning sensation remaining after the shave, will result, which is a problem.

Japanese Patent Application National Publication (Kohyo) No. 9-503424 discloses a rotary electric shaver in which a skin supporting rim is interposed between an outer cutter and an outer cutter frame, so that the skin supporting rim can pivot with respect to the outer cutter frame. More specifically, the skin supporting rim is provided so as to enclose the outer circumference of the outer cutter, and this skin supporting rim is installed so as to be pivotable together with the outer cutter, thus preventing, by the skin supporting rim, the skin from deeply encroaching into the outer circumferential edge of the outer cutter.

FIGS. 6(A) through 7(B) show the pivoting structure disclosed in Japanese Patent Application National Publication (Kohyo) No. 9-503424. FIG. 6(A) is a cross-section taken along the pivot motion axis y, FIG. 6(B) is a cross-section of the pivot supporting point(s) as seen from the direction of the pivot motion axis y, and FIG. 6(C) illustrates the outer cutter and skin supporting rim when they are both tilted. FIGS. 7(A) and 7(B) are illustrations showing the relationship between the pivoted outer cutter and the shaving skin.

In FIGS. 6(A) through 7(B), the reference numeral 10 designates a cutter head unit which is provided on the upper part of a shaver main body (not shown) so that it either can open and close or can be detachably attached. In the cutter head unit 10, three, for instance, sets of cutter units 12, are incorporated at positions that constitute the apexes of an equilateral triangle as seen from above (see FIG. 1). Each cutter unit 12 is comprised of an outer cutter 18 and an inner cutter (not shown) which elastically contacts the inner surface of the outer cutter 18 and is rotated.

The cutter head unit 10 includes an outer cutter frame 14, which either can open and close or can be detachably attached upward with respect to the shaver main body, and three skin supporting rims 16 (only one skin supporting rim is shown) and three outer cutters 18 (only one outer cutter is shown) that are assembled together in the outer cutter frame 14.

Each of the outer cutters 18 is made of thin metal plate, and it has a substantially disc-like cap shape. More specifically, the circumferential edge of a disc is bent (drawn) into a cylindrical shape; and, at the circumferential edge of the opening thereof, a flange 20 is formed to protrude outward in a ring shape. In the circular portion in the center of the outer cutter 18, a multiplicity of slits 22 are formed in a substantially radial pattern. These slits 22 constitute hair introduction openings.

The skin supporting rim 16 are respectively interposed between the outer cutters 18 and the outer cutter frame 14. More specifically, in each of the skin supporting rims 16, a circular outer cutter mounting hole 24 is formed for mounting therein one outer cutter 18 from below; and, in this outer cutter mounting hole 24, the flange 20 of the outer cutter 18 engages from below. The outer circumference of each skin supporting rim 16 is supported by the outer cutter frame 14, so that the skin supporting rim 16 is pivotable in a rim mounting hole 26 formed in the outer cutter frame 14.

More specifically, on the outer circumferential surface of the skin supporting rim 16, a pair of projections 28 (only one of which is shown) project. These projections 28 are formed so as to be perpendicular to a line that passes through the center of the outer cutter 18 and is vertical with respect to the upper surface of the outer cutter 18, that is, vertical to the rotational axis x (see FIG. 6(A)) of the inner cutter, and so as to lie along a straight (diameter) line y passing near the flange 20 of the outer cutter 18. In other words, the projections 28 extend in diagonally opposite directions, with respect to the outer cutter inside thereof, from the outer circumferential surface of the skin supporting rim 16. Each of the projections 28, as seen from FIGS. 6(B) and 6(C), is semicircular arc shape in cross section with a straight line y as the center of such an arc shape and thus has a curved bottom, and the upper surface of each projection 28 has substantially roof-shaped inclined surfaces so that the two sides are inclined downward with the straight line y as the ridge line (straight line where the two inclined surfaces intersect) thereof.

On the other hand, in the rim mounting hole 26 of the outer cutter frame 14, as best seen from FIG. 6(B), a pair of substantially rectangular concavities 30 are formed (FIG. 6(B) show only one concavity 30), so that the two projections 28 of the skin supporting rim 16 engage these concavities 30 (when the shaver has three cutter units 12, then three pairs of concavities 30 are formed in the outer cutter frame 14 so as to correspond to three skin supporting rim 16). Each concavity 30 is formed such that the interior upper surface contains the straight line y of the projection 28 (or is in contact with the ridge line y of the projection 28), and the interior bottom and side surfaces are in slide contact with the curved bottom surface of the projection 28. As a result, the projections 28 turn or rock inside the concavities 30 about the straight line y, and, as a consequence thereof, the skin supporting rim 16 pivots about its projections 28 (more specifically about the straight line y (the straight line y thus being a pivot axis). In other words, the projections 28 (or the straight line y) constitute the axis of pivot of the skin supporting rim 16.

When the projections 28 rock about the straight line y, the inclined upper surfaces of the projections 28 strike the interior upper surface of the concavity 30, and as a result, the pivot angle range of the skin supporting rim 16 is thus restricted by the interior upper surface of the concavity 30 and the inclined upper surfaces of the projections 28 of the skin supporting rim 16. FIG. 6(*c*) illustrations a situation that the skin supporting rim 16 pivots about the two opposing projections 28 (only one shown), and the right side inclined upper surfaces (only one shown) of such projections 28 come in contact with the interior upper surface of the concavities 30 (only one shown), and a further tilting motion of the skin supporting rim 16 is thus restricted.

In the conventional shaver shown in FIGS. 6(A) and 6(B), when the outer cutter 18 is pressed against the skin during shaving, the outer cutter 18 and the skin supporting rim 16 pivot as shown in FIG. 7(A), in which the reference numeral 32 designates the surface of the skin. FIG. 7(A) illustrates the situation that the pressing force F1 the outer cutter 18 against of the skin against is small when the outer cutter 18 or shaver is pressed against the skin not too strongly, and in FIG. 7(B) shows the situation that the pressing force F2 of the outer cutter 18 against the skin is large when the outer cutter 18 or shaver is pressed against the skin strongly.

When the pressing force F1 is small (FIG. 7(A)), even if the skin 32 bulges out beyond the edge of the outer cutter 18, on the outside of the outer cutter 18, it will contact the upper edge of the skin supporting rim 16. As a result, the contact pressure of the skin 32 against the edge of the outer cutter 18 will not become excessive, and there will be almost no danger of the skin 32 being overly deeply shaved or of a burning sensation being produced.

When, on the other hand, the pressing force F2 is large, the skin 32, as illustrated in FIG. 7(B), would pass over the upper edge of the skin supporting rim 16 and bulge out above the outer cutter 18. In this situation, the contact pressure of the skin 32 against the edge of the outer cutter 18 becomes excessive, and problems occur in which overly close shaves and/or burning sensations are produced.

BRIEF SUMMARY OF THE INVENTION

In view of the above, accordingly, the object of the present invention is to provide a rotary electric shaver in which a skin supporting rim is provided between the outer cutter and the outer cutter frame, and in this structure, excessively close shaves and burning sensations that would remain after shaving are prevented even when the pressing force of the outer cutter against the skin is large.

The above object is accomplished by a unique structure of the present invention for a rotary electric shaver that includes a substantially disc-shaped outer cutter, which is formed with a multiplicity of hair introduction openings and held in an upper part of a shaver main body housing therein a motor, and an inner cutter, which while elastically contacting an inner surface of the outer cutter is rotationally driven by the motor; and in the present invention, the shaver further includes an outer cutter frame provided on the shaver main body, and a skin protection rim which is interposed between the outer cutter frame and the outer cutter so as to hold the outer cutter therein and is elastically provided so as to be depressible with respect to the outer cutter frame.

As seen from the above, in the rotary electric shaver of the present invention, a skin protection rim, which holds the outer cutter between the outer cutter and the outer cutter frame, is elastically provided so that it can be depressed (or sink) with respect to the outer cutter frame. Accordingly, when the outer cutter is pressed against the skin with a large pressing force, the outer cutter and the skin protection rim are depressed in the outer cutter frame, and the skin that bulges out to the outside of (or bulges out over) the outer cutter is not only on the skin protection rim but also on the upper edge of the outer cutter frame. As a result, in the present invention, the skin is prevented from contacting the edge of an outer cutter with excessive contact pressure, and thus overly close shaves and burning sensations are prevented.

In the present invention, the skin protection rim is provided so that it can not only be depressed but also pivot with respect to the outer cutter frame. Accordingly, the pivot range of the outer cutter with respect to the shaver main body is large, and a tight contact of the upper surface of the outer cutter with the skin is enhanced. The outer cutter can be elastically provided so as to be depressible with respect to the skin protection rim. With this structure, the skin pressed against the edge of the outer cutter will more easily contact the skin protection rim and outer cutter frame that rise relatively (with respect to the depressed outer cutter) on the outside of the edge of the outer cutter. As a result, the benefits of the present invention (to prevent overly close shaves and burning sensations) become even greater.

In order to provide the skin protection rim depressible (or being capable of making up-and-down motions) with respect to the outer cutter frame, the skin protection rim is held at two supporting points that are positioned on a straight line y (axis of pivot) that passes through the rotational axis (x) of the inner cutter and is perpendicular to that rotational axis (x), and these supporting points are provided so as to be depressed vertically in the outer cutter frame.

In the present invention, the two supporting points of the skin protection rim are formed by projections that project outward from the outer circumference of the skin protection rim, and concavities are formed in the outer cutter frame so that they are long (high) in the up-and-down (vertical) direction and the projections are engaged with these concavities. Springs for pushing the projections upward are installed inside the concavities, so that an upward returning tendency (restorative force) is imparted to the skin protection rim.

The outer cutter and the skin protection rim can be provided in pluralities at equal intervals in the circumferential direction with respect to the center of the outer cutter frame. In this structure, the opposing edges of the skin protecting rims adjacent in the circumferential direction are made to lie substantially along the straight lines that extend outwardly from the center of the outer cutter frame and pass between the outer cutters.

The adjacent skin protection rims are made so as to independently pivot and move up and down. With this structure, the outer cutters and skin protection rims have high degree of freedom of movement, and the motions of the cutter units comprised of the outer cutters and inner cutters become smooth.

In addition, the opposing edges of the adjacent skin protection rims can be mutually coupled by hinges. In this structure, the adjacent skin protection rims function in a linked manner, and the height of the skin protection rims is aligned with the opposing edges; as a result, when, for instance, the cutter head unit of the shaver is moved so as to slide against the skin during shaving, the adjacent outer cutters can be moved smoothly.

BRIEF DESCRIPTION OF THE SEVERAL VIEWS OF THE DRAWINGS

FIGS. 2(A) through 2(D) show in cross-section the structure of the cutter head unit of the shaver of the present invention, including an outer cutter frame and an outer cutter, in which FIG. 2(A) is a view taken along the pivot axis of the outer cutter frame, FIG. 2(B) is a view taken in the direction perpendicular to the pivot axis, FIG. 2(C) is a view of the tilted outer cutter frame and outer cutter, and FIG. 2(D) is a view of the tilted and depressed outer cutter frame and outer cutter;

FIGS. 6(A) through 6(C) show in cross-section the structure of the cutter head unit of the shaver of conventional example, including an outer cutter frame and an outer cutter, in which FIG. 6(A) is a view taken along the pivot axis of the outer cutter frame, FIG. 6(B) is a view taken in the direction perpendicular to the pivot axis, and FIG. 6(C) is a view of the tilted outer cutter frame and outer cutter.

DETAILED DESCRIPTION OF THE INVENTION

Figure 1:
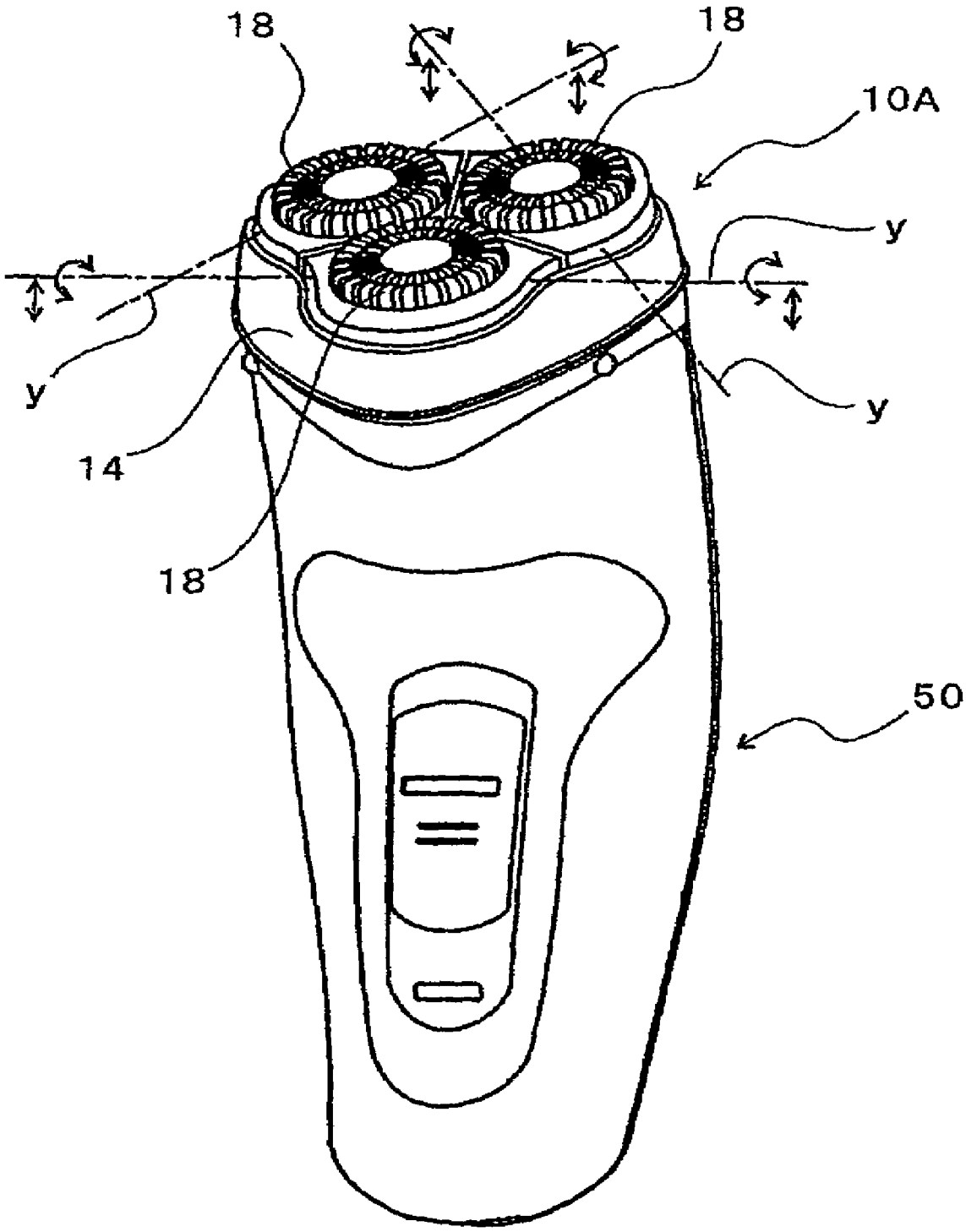
FIG. 1 shows the rotary electric shaver according to one embodiment of the present invention.
Figure 2A:
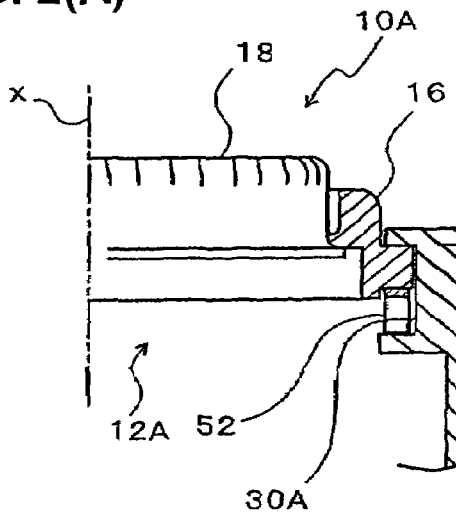
Figure 2B:
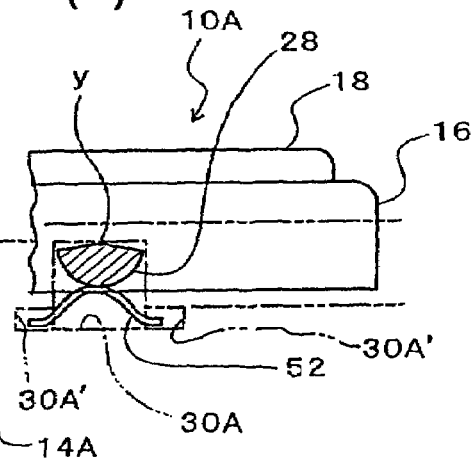
Figure 2C:
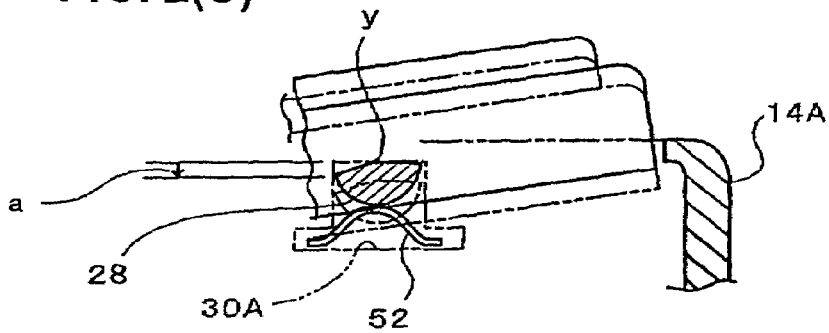
Figure 2D:
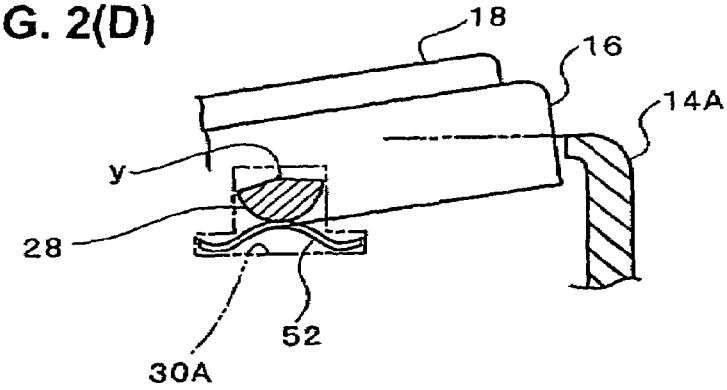
Figure 3A:
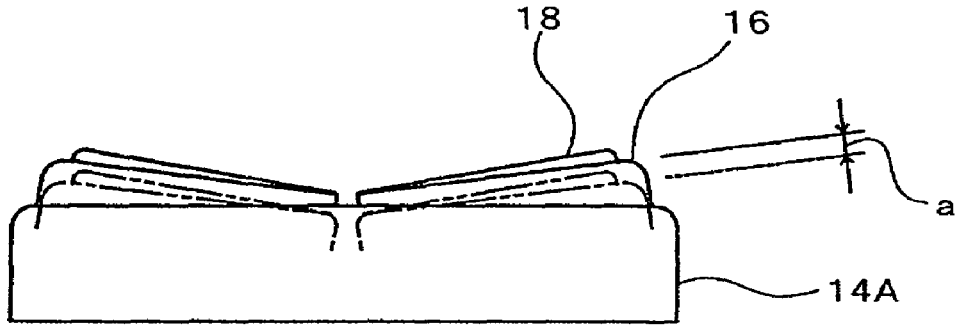
FIGS. 3(A) and 3(B) illustrate the actions of the outer cutter frame and outer cutter of the shaver of the present invention.
Figure 3B:
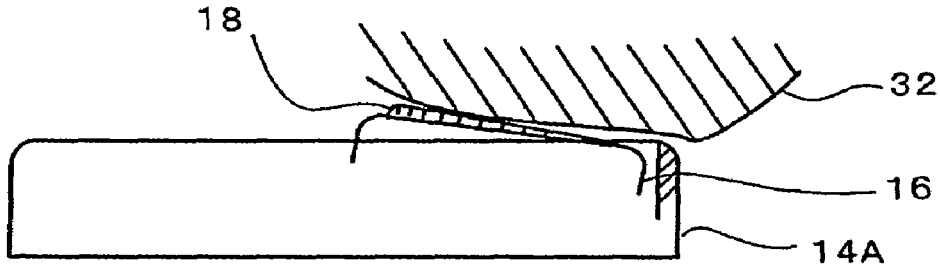
Figure 4:
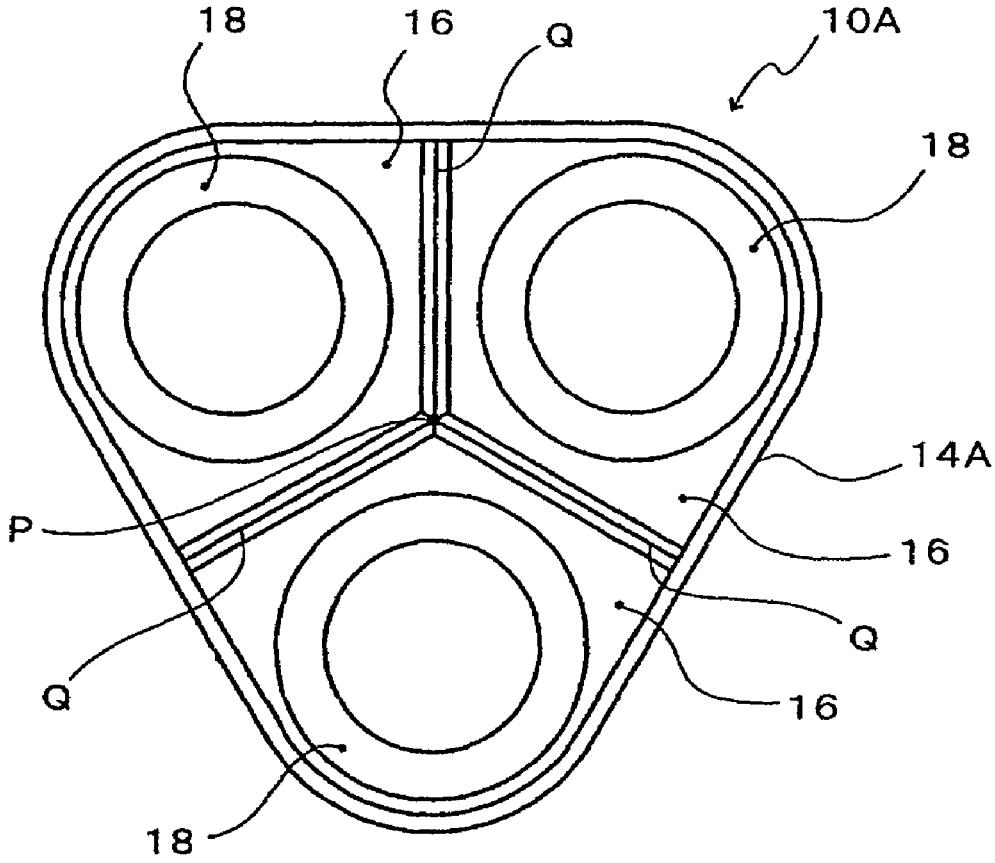
FIG. 4 is a top view of the cutter head unit of the present invention.

FIG. 1 shows the shaver according to the present invention; and FIGS. 2(A) through 2(D) show in cross section the cutter head unit thereof, FIGS. 3(A) and 3(B) illustrate the actions made in the cutter head unit, and FIG. 4 is a top view of the cutter head unit of the shaver, showing three skin protection rims.

In FIG. 1, the reference numeral 50 is a shaver main body. In addition, the curved arrows indicate the pivot motion of the skin protection rims, and straight arrows indicate ascending and descending motion of the depressible skin protection rims, which will be described below, of the present invention. In FIGS. 1 through 3(B), the reference numeral 10A is a cutter head unit, and 12A is a cutter unit. In the shown embodiment of the present invention, the differences from the conventional structure illustrated in FIGS. 6(A) to 7(B) are the shape of the concavities 30A formed in the outer cutter frame 14 with which the projections 28 of the skin supporting rim 16 are engaged and spring means installed inside the concavities 30A. Accordingly, in FIGS. 1(A) to 3(B), the same reference numerals are used for the components that are the same as those of FIGS. 6(A) to 7(B), and descriptions thereof are omitted. The skin protection rims 16 have substantially the same function as the skin supporting rims 16 illustrated in FIGS. 6(A) to 7(B).

As seen from FIGS. 2(A) and 2(B), each of the concavities 30A (only one the concavity 30A is shown) provided in the inner surface of the outer cutter frame 14A is formed so as to be long (or high) in the vertical direction so that both the projection 28 of the skin supporting rim 16 and a wave-shaped plate spring (or an inverted U-shape spring) 52 are installed therein. In other words, each concavity 30A has an interior height that is sufficient to contain therein both the projection 28 of the skin supporting rim 16 and the spring 52 in a vertical relationship or to have therein the projection 28 on top of the spring 52. More specifically, a substantially wave-shaped plate spring (or an inverted U-shape spring) 52 is installed in each concavity 30A formed in the outer cutter frame 14A, and two ends of the spring 52 are installed on the interior bottom surface of the concavity 30A with the center portion of the spring 52 in contact with the bottom of the projection 28 of the skin supporting rim 16. Accordingly, the pair of projections 28 (more specifically, the ridge line y), which are formed on the skin supporting rim 16 to project in the opposite directions and installed inside the concavities 30A of the outer cutter frame 14A, are pushed up by the spring 52 and kept in contact with the interior upper surfaces of the concavities 30A as seen from FIG. 2(B).

In the above structure, both ends of the spring 52 are installed inside spring holding recesses 30A' that extend sideways on both sides of the concavity 30A.

With the structure described above, the skin protection rim 16 pivots about the projections 28 or, more specifically, about the pivot motion axis y. The skin protection rim 16 shown by the solid lines in FIG. 2(C) is in the same situation as that of FIG. 6(C) and is inclined inwardly. When the skin protection rim 16 is pressed down, for instance, during shaving, by the skin being shaved, the projection(s) 28, while compressing the spring(s) 52, descend inside the concavity(s) 30A; as a result, the skin protection rim 16 is moved (descents) to the position shown by the imaginary lines in FIG. 2(C), that is, to the position shown in FIG. 2(D), pushing down and squeezing the spring 52, so that the protection rim 16 is depressed. In FIG. 2(C) and FIG. 3(A), the distance "a" represents the amount for which the skin protection rim 16 is depressed.

In the situation shown in FIG. 2(D), the upper edge of the skin protection rim 16 approaches (or is close to) the upper edge of the outer cutter frame 14A. As is clear from FIG. 3(A), when the skin protection rim 16 descends, the upper edge of the outer cutter frame 14A ascend relatively with respect thereto. As a result, the skin 32 (see FIG. 3(B)) is received (supported), outside the outer cutter 18, by the skin protection rim 16 and the outer cutter frame 14A, with no excessive contact pressure applied to the skin. As a result, overly close shaves and burning sensations are prevented.

FIG. 3(B) illustrations another situation in which the skin protection rim 16 pivots in the opposite direction from the pivot direction of FIG. 3(A). When, as seen from FIG. 3(B), the edge of the skin protection rim 16 tilts on the outer cutter frame 14A side and is depressed, the skin protection rim 16 sink in further down than the outer cutter frame 14A; accordingly, skin protection is even further assured. In addition, the outer cutter 18 is pushed up by the inner cutter (not shown), and therefore, the outer cutter 18 can be depressed with respect to the skin protection rim 16. For this reason, since the outer cutter 18 is depressed as well as the skin protection rim 16, skin protection is effected even more assuredly.

As illustrated in FIG. 4, three skin protection rims 16 are provided. In this arrangement, the opposing edges of adjacent skin protection rims 16 are formed so as to lie along each one of the straight lines Q which extend from the center P of the outer cutter frame 14A and pass between adjacent pair of the outer cutters 18 to the outer edges of the outer cutter frame 14A. The adjacent skin protection rims 16 are provided so as to move (pivotably and depressibly) independently of each other. However, these opposing edges (along lines Q in FIG.

4) can be mutually coupled by hinges which are provided in the back (inner) surfaces of the skin protection rims 16, so that adjacent skin protection rims 16 are mutually linked and move together or cooperatively.

Figure 5:
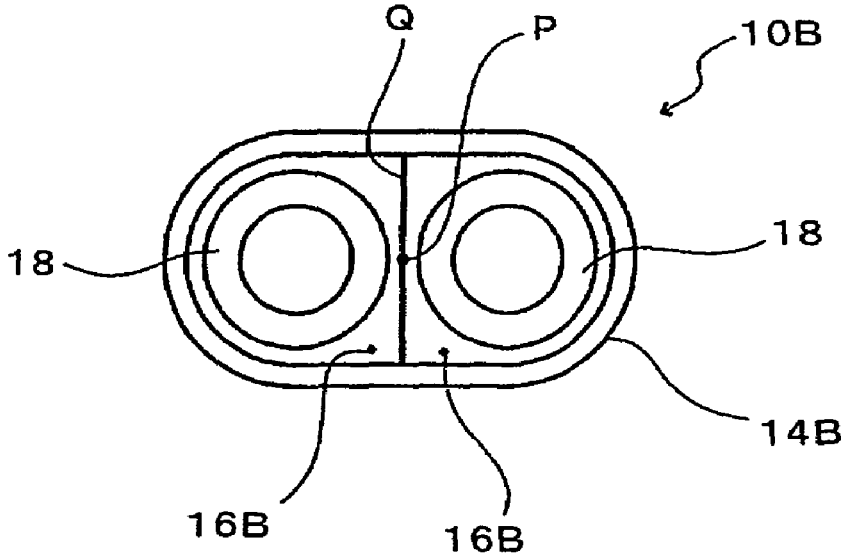
FIG. 5 is a top view of another cutter head unit of the present invention.
Figure 6A:
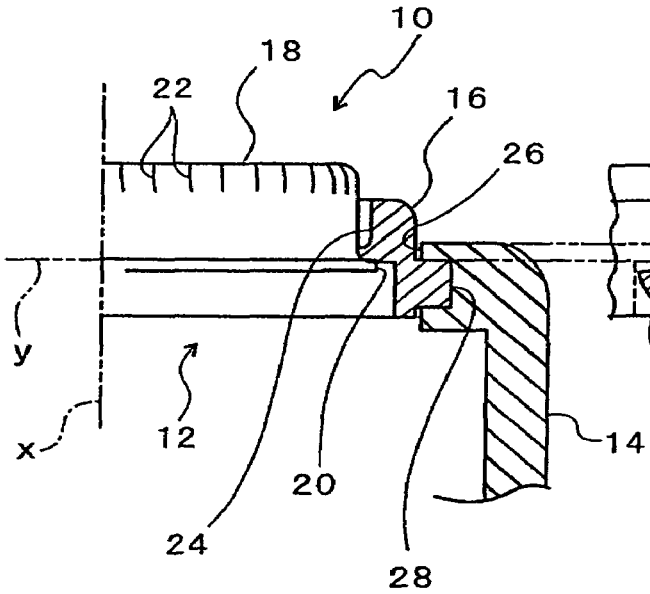
FIG. 6(A) PRIOR ART
Figure 6B:
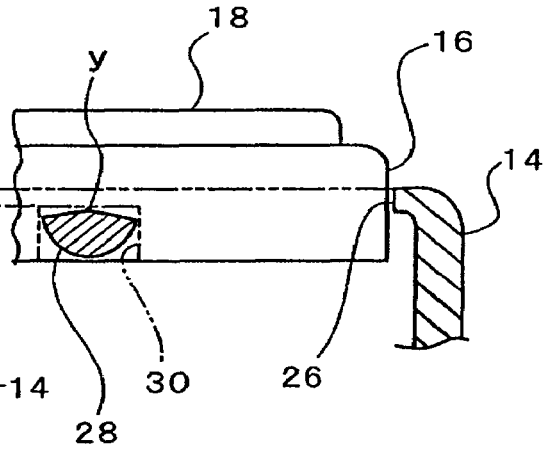
FIG. 6(B) PRIOR ART
Figure 6C:
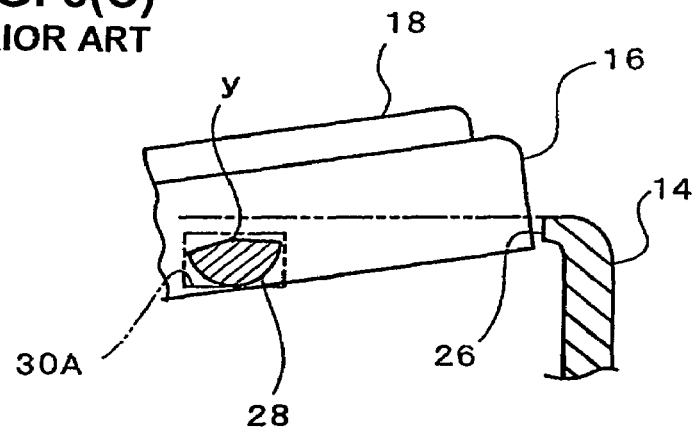
FIG. 6(C) PRIOR ART
Figure 7A:
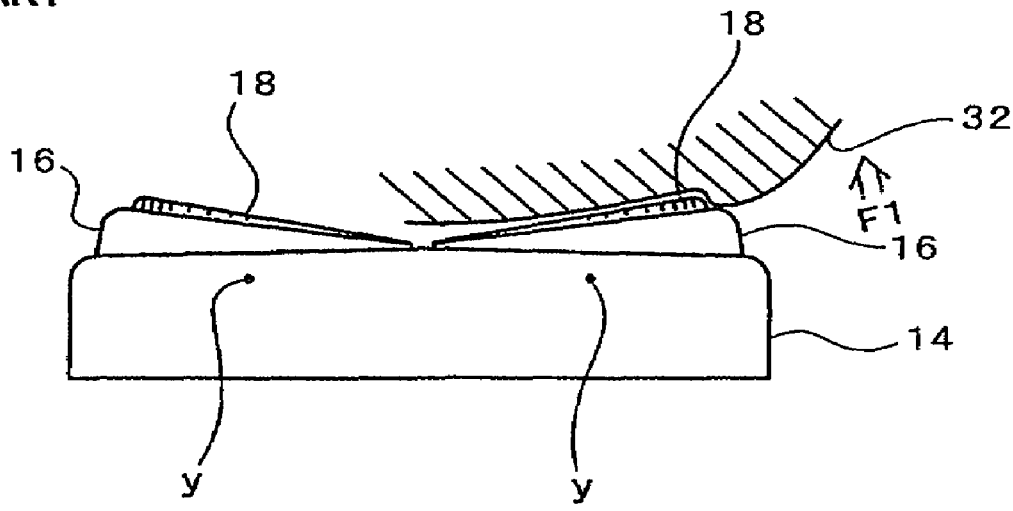
FIG. 7(A) PRIOR ART
FIGS. 7(A) and 7(B) illustrate the actions of the outer cutter frame and outer cutter of the shaver of conventional example.
Figure 7B:
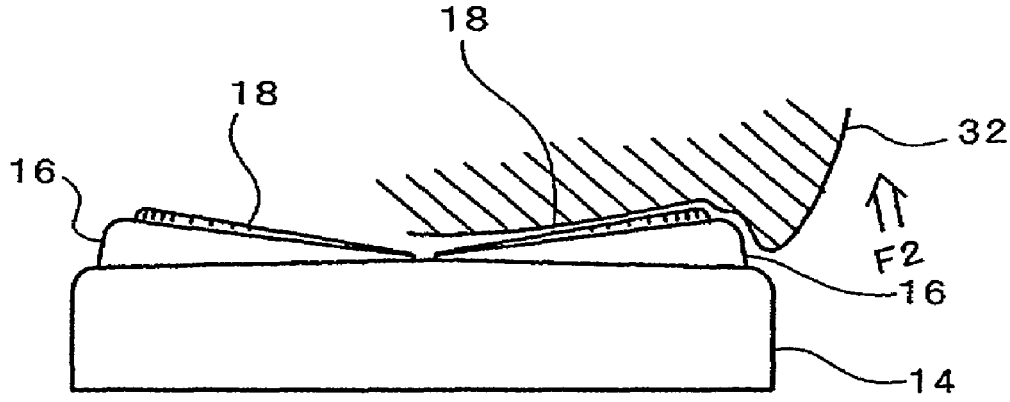
FIG. 7(B) PRIOR ART

FIG. 5 shows a cutter head unit 10B of a shaver that has two outer cutters 18.

In this shaver, the outer cutter frame 14B has an oblong shape, and two skin protection rims 16B respectively enclosing the outer cutters 18 are given a shape that divides the inside of the outer cutter frame 14B with a straight line Q that passes through the center P of the outer cutter frame 14B and is perpendicular to the longer axis of the oblong outer cutter frame 14B.

The two skin protection rims 16B are independently provided so as to move (pivotably and depressibly) independently from each other; and the skin protection rims 16B can also be designed so that they are coupled by hinges at their opposing edges (along lines Q in FIG. 5) so as to move together or cooperatively.

The invention claimed is:

1. A rotary electric shaver comprising a substantially disc-shaped outer cutter, which is formed with a multiplicity of hair introduction openings and held in an upper part of a shaver main body housing therein a motor, and an inner cutter, which while elastically contacting an inner surface of said outer cutter is rotationally driven by said motor, said shaver further comprising:

an outer cutter frame provided on said shaver main body; and a skin protection rim which is interposed between said outer cutter frame and said outer cutter so as to hold said outer cutter and is elastically provided so as to be depressible with respect to said outer cutter frame; and wherein said skin protection rim is elastically provided so as to be pivotable and depressible with respect to said outer cutter frame;

said skin protection rim is held in said outer cutter frame at two supporting points provided on a straight line that passes through a rotational axis of said inner cutter and is perpendicular to said rotational axis, and said two supporting points are depressible with respect to said outer cutter frame;

said two supporting points are projections formed on one of an outer circumference surface of said skin protection rim and the outer cutter frame, and said projections are engaged with concavities formed in another one of said outer cutter frame and said outer circumferential surface of said skin projection rim so as to allow said skin projection rim to make a rocking motion and movable up and down in vertical direction with respect to said outer cutter frame, and wherein each of said concavities formed in said outer cutter frame is provided therein with spring means for urging pushing said projection upward.

2. The rotary electric shaver according to claim 1, wherein said outer cutter is elastically supported so as to be depressible with respect to said skin protection rim.

3. The rotary electric shaver according to claim 1, wherein a plurality of outer cutters are provided in said outer cutter frame at equal intervals in a circumferential direction with respect to a center of said outer cutter frame;

inner cutters and skin protection rims are provided so as to correspond to said plurality of outer cutters; and opposing edges of said skin protecting rims which are adjacent to each other in a circumferential direction are provided substantially along straight lines extending from the center of the outer cutter frame and passing between adjacent outer cutters.

4. The rotary electric shaver according to claim 3, wherein adjacent skin protection rims are coupled to each other by hinges at opposing edges thereof.

* * * * *